US005676234A

United States Patent [19]

Smith et al.

[11] Patent Number: 5,676,234

[45] Date of Patent: Oct. 14, 1997

[54] COIN/TOKEN SORTING METHOD

[75] Inventors: Peter R. Smith, Victoria; Darren E. Beauchamp, New South Wales, both of Australia

[73] Assignee: Microsystem Controls Pty Ltd., Australia

[21] Appl. No.: 647,028

[22] Filed: May 9, 1996

Related U.S. Application Data

[63] Continuation-in-part of Ser. No. 396,332, Feb. 28, 1995, Pat. No. 5,535,872, which is a continuation of Ser. No. 7,604, Jan. 22, 1993, abandoned, which is a continuation-in-part of Ser. No. 961,893, filed as PCT/AU91/00295, Jul. 4, 1991, Pat. No. 5,476,168.

[30] Foreign Application Priority Data

May 7, 1990 [AU] Australia ..... PK 1057

[51] Int. Cl.[6] ..... G07F 3/04

[52] U.S. Cl. ..... 194/346

[58] Field of Search ..... 194/346, 3.7, 3.8, 194/3.9; 193/31.4, DIG. 1; 453/3

[56] References Cited

U.S. PATENT DOCUMENTS

| | | | |
|---|---|---|---|
| 3,870,137 | 3/1975 | Fougere . | |
| 4,105,105 | 8/1978 | Braum | 194/319 |
| 4,410,077 | 10/1983 | Okolischan . | |
| 4,570,779 | 2/1986 | Abe | 194/344 X |
| 4,582,189 | 4/1986 | Schmitt | 194/346 X |
| 4,838,406 | 6/1989 | Levasseur | 194/346 |
| 4,884,672 | 12/1989 | Parker | 194/346 X |

FOREIGN PATENT DOCUMENTS 1321241 6/1973 United Kingdom .

*Primary Examiner*—F. J. Bartuska
*Attorney, Agent, or Firm*—Reed Smith Shaw & McClay

[57] ABSTRACT

The invention relates to a method of sorting coins according to predetermined information and allowing the coins to pass to a required outlet in accordance with the predetermined information, including the steps of:

(a) detecting the presence of a leading edge portion of a coin falling into a free fall reference path above the outlets; and either (b) if the predetermined information indicates the coin-token is to be allowed to be accepted:

(i) energising a solenoid to withdraw a separator from the reference path at a location above the outlets to allow the coin to free-fall towards and into the acceptance outlet;

(ii) maintaining the solenoid energised, and thus the separator withdrawn from the reference path, for a predetermined period of time;

(iii) resetting the predetermined time if the predetermined information indicates a following coin is also to be accepted; and (iv) de-energising the solenoid at the expiry of the predetermined period of time to allow the separator to move into the reference path;

or (c) if the predetermined information indicates the coin is to be rejected:

(i) maintaining the separator in the reference path at a location above the outlets to deflect a leading edge portion of the coin to direct the coin towards and into the reject outlet; or (ii) de-energising the solenoid to allow the separator to move into the reference path above the outlets to deflect the leading edge portion of the coin to direct the coin towards and into the reject outlet.

9 Claims, 2 Drawing Sheets

COIN/TOKEN SORTING METHOD

CROSS-REFERENCES TO RELATED APPLICATIONS

This application is a continuation-in-part of application Ser. No. 08/396,332, filed Feb. 28, 1995, now U.S. Pat. No. 5,535,872; which is a continuation of application in Ser. No. 08/007,604, filed Jan. 22, 1993, now abandoned; which in turn is a continuation-in-part of national stage application Ser. No. 07/961,893, now U.S. Pat. No. 5,476,168, filed Jan. 4, 1993, which is based on PCT application No. PCT/AU91/00295 filed Jul. 4, 1991 which claims priority of Australian application Serial No. PK1057 filed Jul. 5, 1990.

FIELD OF THE INVENTION

This invention relates to a method of sorting coins and/or tokens.

BACKGROUND OF THE INVENTION

Generally speaking, high speed coin/token operated gaming machines, ie. poker machines or slot machines, have been limited to single coin/token acceptance.

In each of the above applications, especially in gaming machines, the quicker the coin/token validation system can operate the greater the turnover possible from such machines. It has recently been proposed in relation to gaming machines that input hoppers may be attached to the machine to allow an operator to play the game more quickly.

In many countries of the world, the use of coins is expanding, resulting a large number of coins of different dimensions, mass, material and denomination in each country. For example, Australia uses coin values of 5c, 10c, 20c, 50c, $1 and $2. The six coins are all of different dimensions and mass, and with variations in material. For 50c coins, there are different shapes, particularly for commemorative coins. All these coins may be useable in coin freed mechanisms such as, for example, vending machines, parking machines, toll booths entry turnstiles, telephone call-boxes, and certain gaming machines. A similar position exists in many other countries such as, for example, England, France, Germany, Spain and Finland. Very few countries require coins of a fixed denomination for use in coin-freed mechanisms.

In Application No PCT/AU91/00295 a coin validation system is disclosed which pulses an incoming coin and analyses a back EMF curve or de-energisation curve to obtain a signature of the incoming coin/token. This is compared to reference information. It is possible to analyse many (10 or more) coins/second and provide a signal to an accept/reject mechanism which forms part of the coin path. If an invalid coin is identified the accept/reject mechanism does not move from constituting part of the coin path. However, if a valid coin is identified the accept/reject mechanism withdraws from the coin path and that coin is allowed to pass to another passageway.

Particularly with top-entry, coin-freed mechanisms it is possible for a large number of coins of mixed denominations to be placed in the entry chute in a short time. This can be achieved by placing the coins on the palm of a hand and directing them into the entry chute. This creates a coin stream where the coins can be tailgating each other. This means the leading edge of a coin abuts the trailing edge of the coin immediately ahead. As coins pass through a coin accept/reject mechanism under the influence of gravity, these is no control over the speed of a coin, or a stream of coins, as it or they pass through the mechanism.

The validating and accept/reject mechanisms, and the sorting method, must be capable of handling such a stream of coins with reliability, speed, and regularity. If this cannot be achieved, there must be added a mechanism to slow the coins, or there will be jamming. With entry turnstiles or toll booths, this could prove disastrous. For a gaming machine, a jam requires the attendance of a technician with the resultant down time. As such a machine can cost several tens of thousands of dollars, the loss of productivity is not only considerable, but may have adverse effects on the viability of the machine.

With a steam of tailgating coins of generally of the one denomination but with an occasional coin of different denomination, the accept/reject mechanism should be capable of removing the coins of different denomination without effecting the remainder of the stream. With gaming machines, the majority of the coins entering the machines will be coins of the value of those dispensed as winnings. This is because most players re-use the coins dispensed as winnings. However, there may be an occasional invalid or incorrect coin, including slugs, washers or tokens, from the player's pocket. The stream of valid coins should be allowed to pass as quickly as possible. As gravity is the "driving force" for the passage of coins, the fastest speed achievable by a coin is free fall. That requires the accept/reject mechanism to be able to remove the invalid or incorrect coin from the stream of coins without effecting the valid coins and allowing them to continue to free fall without slowing. With tailgating coins, a slowing of the stream may cause a coin jam.

It will be evident that if the accept/reject mechanism used in association with the coin validation system cannot react as quickly as the validation system, there will be no overall increase in the speed with which coins/tokens can be processed.

Further, current coin validation systems aim to identify valid coins from invalid coins. In gaming machines there is a further need to process the stream of valid coins. For example to direct a coin or coins in the stream to different locations.

With current designs, coins are introduced into the machine through a coin validator (comparator) which, with the exception of the validator the subject of Application No PCT/AU91/00295, have a limited ability of only being able to recognise one particular coin denomination. These coins are directed via a diverter gate to either the coin hopper or the cash box. If the hopper is full, a signal is given to the diverter to direct coins to the cash box. When the coins in the hopper fall to a preset level a signal is then given to the diverter to change position and direct all coins to the coin hopper.

As the complexity of the games played upon gaming machines has increased so has the maximum bet value. It is not uncommon to have a $10 bet on a 20¢ machine which would require the insertion of 50 coins, a tedious task. Player acceptance and cash input could both be increased if the machine were capable of accepting 20¢ coins plus higher denominations eg $1 and $2 coins and provide the appropriate number of 20¢ credits, and sort the coins so that the 20c coins enter the hopper to be able to be paid-out, and the other coins pass to the bin. With gaming machines, the majority of coins entering the machines will be the coins of the value of those dispensed as winnings. This is because most players re-use coins dispensed as winnings. However, there may be an occasional coin of different value obtained from the player's pocket.

The speed of operation of the sorter mechanism is therefore becoming critical if it is to separate a higher volume of coin or token throughput and/or sort multi-denominational coin token streams. Current sorting mechanisms are not capable of reliably sorting a stream of multi-denominational coins into two paths at more than 3 coins/second, and definitely not at the required speed of 10 coins/second.

Examples of such prior art mechanisms are in U.S. Pat. No. 4,105,105 of Braum; U.S. Pat. No. 4,438,406 of Levasseur; and U.S. Pat. No. 4,884,672 of Parker.

In Parker, there is shown a mechanism which has a coin chute 26. A coil system 24 determines whether a particular coin is to be accepted or rejected. If accepted, coil 82 operates to attract gate 80 so that lower end 84 is withdrawn from the coin path to allow the coin to pass into accepted coin chute 52. A sensor 36 in the chute 52 then re-sets gate 80 so that lower end 84 re-enters the coin path. If the coin is to be rejected, gate 80 remains in the path to divert a rejected coin laterally through a rejected coin port 54.

This mechanism has a number of difficulties:

(i) the forcing of a coin laterally causes the coin to lose all speed, and thus a slow operation can result as it is necessary to await the passage of the coin into the reject chute before the next coin can be processed;

(ii) the gate is reset after each accepted coin, thus causing a delay during the resetting period. It also causes unnecessary repetitive movement of the gate;

(iii) if the gate resets when a coin is passing, it could jam a coin in the reject coin port 54, against wall 56, and wall 12 of chute 52. This would jam the mechanism entirely thus requiring a technician to dismantle the machine to clear the blockage. As spring 88 biases gate 80 to the reject position, removal of power to coil 82 would not clear the blockage.

The consequences of (i) and (ii) above are to considerably slow the operation of the machine, such that mechanism coin speeds in excess of 3 coins per second are unlikely. Therefore, Parker cannot cope with a stream of tailgating coins.

In coin-operated devices such as, for example, vending machines, telephones or gambling machines, it is required that the default state be the reject path. As the majority of coins passing through the coin mechanism will be of the correct value, they will be required to pass to the accepted coin chute. Therefore, the gate 80 must move twice for each (valid) coin, thus slowing the operation of the mechanism and thus the machine in which it is fitted. It also increases the likelihood of jamming at speed due to sequencing errors.

These problems are also present in Braum where there is a free-failing coin chute 4 defined by wails 2 and 3. A pivotally-mounted sorting chute 5 diverts a coin to either a reject chute 9 or an accept chute 10. The sorting chute 5 is biased to the reject chute 9 by spring 52, with a magnet 50 being used to move the chute 5 against spring 52 to the acceptance chute 10.

As sorting chute 5 has to divert coins to both chutes 9, 10, every coin must contact the sides of sorting chute 5 to be diverted. This can cause a slowing of the movement of each coin as it passes along sorting chute 5.

Furthermore, as the majority of coins used will be accepted, for the majority of coins the sorting chute 5 must move twice—to the position for the acceptance chute 10, and then back to the reject chute 9.

This duplication in movement considerably slows the operation of the mechanism and, again, increases the likelihood of jamming or incorrect direction due to sequencing errors.

With the Braum mechanism if a coin in sorting chute 5 has to pass to reject chute 9, and the following coin is to pass to accept chute 10, the sorting chute 5 cannot move to above accept chute 10 until the first coin has completely cleared sorting chute 5 or the coin may jam between sorting chute 5 and wall 7, thus blocking both exit chutes 9, 10 and jamming the mechanism. The side walls of sorting chute 5 would encourage such a coin jam. Therefore, coins to be sorted must be separated by at least the time taken for the chute 5 to move from one position to the other.

It is noted that with Braum there is no disclosure of the timing for return of the sorting chute 5 to its rest position over the reject chute 9.

Therefore, Braum cannot cope with a stream of tailgating coins.

In FIGS. 9 and 10 Braum discloses a different mechanism where a coin balance 1003 is used to remove coins of incorrect diameter. It also slows the coins so that only one coin is in the track 1004 at the one time. This is due to the pivotal arrangement of exit gates 54 and 1005, both of which must return to their original (rest) position shown before it can be contacted by a following coin after an earlier coin has been passed to exit 910. If not, mis-direction or jamming must occur.

Therefore, the embodiment of FIGS. 9 and 10 of Braun cannot cope with a stream of tailgating coins.

Furthermore, as the coins roll along a pathway, optimum coin speed cannot be achieved.

Mechanisms such as Braum can have a maximum speed of 3 coins per second, which is considered unacceptably slow.

Levasseur discloses a mechanism having an opening 22 in a wall 18, 20. A gate 24 is pivotally mounted in the opening 22 for movement between a first position where a coin is allowed to free fall into a first (reject) chute 36, and a second position where the coin is diverted to pass down a second (accept) chute 40. The movement of the gate 24 is by means of two solenoids 60, 62 in conjunction with a snap spring 80.

The top of the gate 24, when in the first and second positions, presses against walls at 42, 44. If a sequencing error occurred and the top of gate 24 jammed against a coin which then pressed against either wall, that would leave the gate 24 midway between positions. As the spring 80 may not have snapped over, and either or both solenoids 60, 62 may be operating, not only may there be a jamming of the mechanism, causing a complete blockage, but also there may be damage to the mechanism.

Furthermore, the substantial contact with gate 24 when diverting a coin to the accept (second) position may sufficiently slow a coin to slow the operation of the mechanism.

Also, the gate is returned to the first (reject) position after a finite period, or after a coin has passed a downstream sensor. This, again, results in the gate 24 moving twice for each acceptable coin (which are the majority) thus slowing the mechanism, and increasing the likelihood of incorrect direction or jamming due to sequencing errors. As a result, Levaseur, like Braum, cannot achieve the speed necessary to sort a stream of tailgating coins.

As the gate 24 cannot move until a coin has completely passed the gate 24, and as gate 24 requires a finite time to move from one position to the other, there must be a gap between coins or there will be a misdirection or coin jam.

Therefore Levasseur, like Braum, cannot cope with a stream of tailgating coins.

DESCRIPTION OF THE INVENTION

It is therefore the principal object of the invention to provide a method of sorting coins which allows for maximum speed and minimum risk of jamming. Sorting is taken as including an accept/reject function performed in, for example, a coin validator; as well as sorting function based on coin denomination performed in, for example, a coin separator.

Accordingly, the present invention provides a method of sorting coins/tokens according to predetermined information and allowing the coins/tokens to pass to a required outlet of a plurality of outlets in accordance with the predetermined information, including the steps of:

(a) detecting the presence of a leading edge portion of a coin/token falling into a free fail reference path above the plurality of outlets; and either (b) if the predetermined information indicates the coin-token is to be allowed to pass to a predetermined one of the plurality of outlets:

(i) energising a solenoid to withdraw a separating means from the reference path at a location above the plurality of outlets to allow the coin/token to free-fall towards and into the predetermined outlet;

(ii) maintaining the solenoid energised, and thus the separating means withdrawn from the reference path, for a predetermined period of time;

(iii) resetting the predetermined time if the predetermined information indicates a following coin/token is also to be allowed to pass to the predetermined outlet; and (iv) de-energising the solenoid at the expiry of the predetermined period of time to allow the separating means to move into the reference path; or (c) if the predetermined information indicates the coin/token is to be deflected to pass to another of the plurality of outlets:

(i) maintaining the separating means in the reference path at a location above so the plurality of outlets to deflect a leading edge portion of the coin/token to direct the coin/token towards and into the another outlet; or (ii) de-energising the solenoid to allow the separating means to move into the reference path above the plurality of outlets to deflect the leading edge portion of the coin/token to direct the coin/token towards and into the another outlet.

Preferably, the predetermined outlet is a continuation of the free fall reference path.

More preferably, the predetermined time is at least as long as the time taken for a coin/token to pass from the point of detection referred to in (a) above, to exit from an outlet.

Advantageously, a preset open delay time is required to have expired before step (b)(i) can commence if a previous coin/token was to be deflected in accordance with step (c)(i) or c(ii).

Furthermore, step (b)(i) can commence immediately the preset open delay time has expired.

More advantageously, the preset open delay time is at least as long as the time taken for the leading edge of the previous coin/token to move from the instant of deflection and its leading edge portion enter the another outlet.

More preferably, the preset open delay time is less than the time taken for the smallest coin to be sorted to pass the point of deflection.

Preferably, step (c)(ii) commences after a preset close delay time has expired, the preset close delay time being the time taken for the leading edge portion of a coin to pass from the point of detection referred to in step (a) above, to the point where the leading edge portion of the coin is deflected in accordance with step (c)(i) or (ii) above The leading edge portion of a coin is the leading edge and that part of the coin immediately behind the leading edge.

DESCRIPTION OF THE DRAWINGS

The invention is now illustrated with reference to the accompanying drawings in which.

DESCRIPTION OF THE PREFERRED EMBODIMENT

Figure 1:
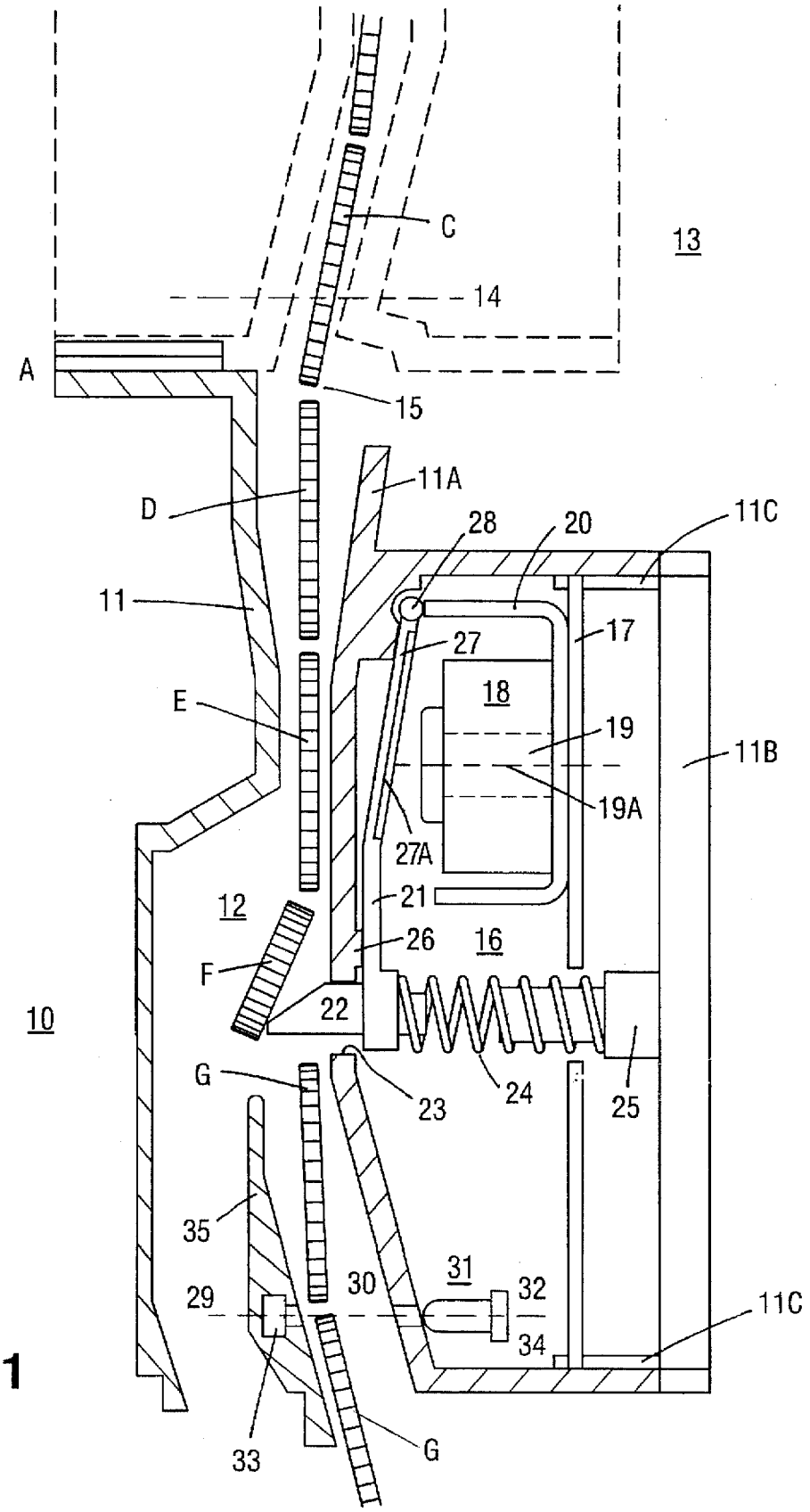
FIG. 1 is a cross-sectional view of a sorter according to one form of the invention.

As shown in the drawing, the sorter 10 comprises a multi part housing 11, 11A and a cover 11B. Housing 11 and 11A combine to define a coin/token chute through which a coin/token may pass.

A coin/token validator 13 is shown in ghost outline to which the sorter 10 is slidingly engaged at A. The coin/token validator 13 has a coin/token exit sensor 14 which senses the leading edge 15 of an exiting coin/token. This information is used in conjunction with other coin/token validator information to initiate the separating function of sorter 10. The preferred coin/token validator is disclosed in patent application no. PCT/AU91/00295.

Whilst the drawings show sorter 10 in combination with a coin/token validator its use is not so limited. It will be clear to any person skilled in the art that the sorter 10 can function in response to any predetermined information. The sorter may be a validator and thus performs an accept/reject function, or a separator which sorts coins based on their denomination.

The sorting mechanism 16 is mounted within housing 11A via a printed circuit board 17, which is held in place by projections 11C on cover 11B. This mechanism 16 includes an electromagnet 18 comprised of a solenoid coil 19, an extended magnetic pole 20 and solenoid core 19A.

As shown if FIG. 1, the sorter 10 is in a deflecting position. Arm 21 has a projection 22 extending through opening 23 in housing 11A. The projection 22 has an angle plate surface which assists to achieve the desired deflection. No other openings are provided in housing 11A which restricts the potential for dirt and moisture entering and interfering with the sorting mechanism 16. Housing 11A and cover 11B combine to provide a sealed unit for electronics.

Projection 22 is urged through opening 23 by a spring 24 mounted upon a base 25 of cover 11B.

A stop gate 26 also provides a pivot point by which the combined operation of spring 24 on projection 22 biases the other end 27 of arm 21 into contact with extended magnetic pole 20. Extended magnetic pole 20 is made of a magnetic material and contacts one end of solenoid core 19A. Therefore, when solenoid coil 19 is energised, extended magnetic pole 20 becomes an extension of the polarization of that end of core 19A contacted by it.

End 27 of arm 21 is either made of a magnetic material, or contains a plate 27A of magnetic material. Plate 27A extends from a floating pivot 28 to beyond solenoid core 19A. Where solenoid coil 19 is energised, extended magnetic pole 20 becomes polarized and attracts end 27 into contact with it. Plate 27A then becomes polarized the same as extended magnetic pole 20. This is opposite to the polarization of core 19A adjacent arm 21. Therefore, there is a strong attraction of arm 21 to core 19A. Arm 21 is thereby attracted towards solenoid core 19A thereby withdrawing projection 22 from the reference path 12 against the bias of spring 24. The incoming coin will free fall uninterrupted through reference path 12 and through exit passageway 30 and exit the sorter 10.

Upon de-energisation due to either the predetermined time expiring or a signal being generated requiring de-energization, the solenoid coil 19 no longer attracts arm 21. Spring 24 operates to urge projection 22 into the reference path 12 and into contact with the leading edge portion of an incoming coin to deflect the coin from its continuing free fall path into a new free fall path towards and into exit passageway 29. Once the coin has been induced to move into the direction towards exit passageway 29, solenoid 19 may again be energised to attract arm 21 and thus withdraw projection 22.

A small gap 27B is maintained between arm 21 and core 10A even in the withdrawn position (FIG. 2) to prevent magnetic memory in plate 27A. Base 25 is of sufficient length to achieve this.

A sensing system 31 may be located at the lower part of exit passageway 30. System 31 comprises a light emitting diode 32, a lens 33 and receiver 34. The LED 32 and receiver 34 are mounted side by side in the body formed by housings 11A and 11B opposite the lens 33 which is located in partition 35.

The sensor system 31 operates such that light from LED 32 travels horizontally across exit passageway 30 and enters the base of lens 33. The light is reflected internally at one point on the internal surface of lens 33. It is then reflected upon an opposed point of the internal surface of lens 33 and in turn back across the exit passageway 30 into receiver 34.

Any coin/token breaking either or both light beams will cause a signal to be generated. This sensor system 31 is located close to the exit of the sorting mechanism 10 below separating mechanism 16 thereby ensuring that a coin/token which generates a signal has in fact left the sorter 10.

The sensing system 31 can be used to generate signals to facilitate measurement of the quantity of coins/tokens going through exit passageway 30.

The chute 12 is split into two exit passageways 29 and 30 by partition 35. Partition 35 is sufficiently below opening 23 that any sorting of coins/tokens by the projection 22 is not interfered with.

Figure 2:
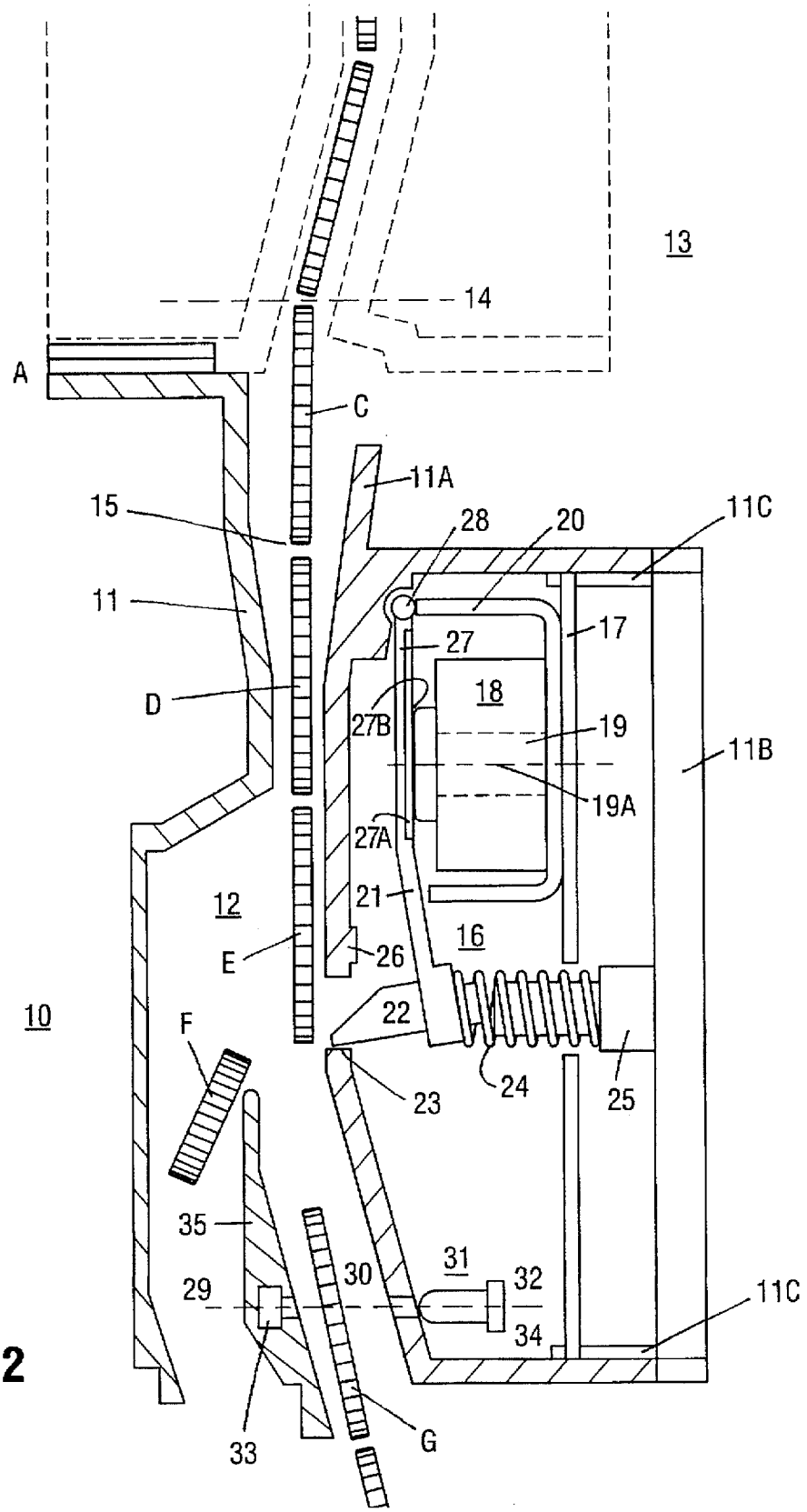
FIG. 2 is a cross sectional view of the sorter of FIG. 1 after the elapse of a short period of time.

As can be seen from FIGS. 1 and 2, there is shown a stream of coins including coins C,D,E,F and G. Coins C,D,E and G are identical and are all to pass to exit passageway 30. Coin F is different and is to pass to exit passageway 29.

In operation, a coin/token C falls from coin/token validator 13. The leading edge portion 15 of coin C is sensed and a control signal is generated so that at the appropriate time exit passageway 30 is either maintained blocked by projection 22 or solenoid coil 19 is energised to withdraw projection 22. In the latter case a timing mechanism (not shown) can control the time of commencement and period of energisation of the coil 19 and hence both when and the length of time that projection 22 is withdrawn.

By sensing the leading edge 15 of coin/token C and allowing the coin to free fall, no matter the size or mass of coin/token C the same time will elapse between the coin passing detection point 14 and reaching the projection 22, irrespective of the size, mass or denomination of the coin. This principle allows the use of predetermined and/or preset times and time delays which are independent of the size, mass or denomination of the coin. As there is a known and fixed lag time in the operation of the electromagnet 18 (both at energisation and de-energisation), compensation can be included in the timing of the operation of sorting mechanism 10.

For coin G, projection 22 was withdrawn to allow coin G to continue to free fall into exit passageway 30. When the leading edge portion of coin F reaches projection 22, solenoid coil 19 has been de-energised to allow protection 22 to re-enter free fall path 12 and contact the leading edge portion of coin F. The leading edge portion of a coin is the leading edge and that part of the coin immediately behind the leading edge. This deflects coin F towards exit passageway 29. When the leading edge portion of coin F enters exit passageway 29, projection 22 is withdrawn (FIG. 2) to enable coins E, D and C to free fall into exit passageway 30.

Therefore, projection 22 has been moved to the deflecting position only once to deflect the one required coin F from a stream of coins. Furthermore, it is not necessarily required to stay in that position for the full coin transition time, being the time taken for a coin to pass from the detection point 14 through any outlet.

In operation, the generated control signal provides predetermined information relative to the coin being examined. The arrangement is such that for a particular coin or sequence of coins certain steps occur:

(a) If the predetermined information is that the coin is to be accepted, electromagnet 18 is energised at the appropriate time thus attracting arm 21 against the effect of spring 24. Therefore, projection 22 is withdrawn from accept exit passageway 30 to allow the coin to free-fall into accept exit passageway 30. After the predetermined time, electromagnet 18 is de-energised to release arm 21 and allow it to be moved by spring 24 to enable projection 22 to pass through opening 23 to block accept exit passageway 30. The predetermined time is a least as long as the time taken for a coin/token to pass from the detection point 14 to an outlet. If the time between the leading edges of successive coins is less than the predetermined time, there may be at least two coins in the system. This allows the sorter 16 to remain in the position shown in FIG. 2 (with projection 22 withdrawn) until it is determined if the following coin(s) are to pass to exit passageway 29 or exit passageway 30. This reduces the unnecessary operation of sorter 16 and allows projection 22 to remain withdrawn for a lengthy stream of coins all of which are to be allowed to pass to exit passageway 30.

(b) If the predetermined information is that the coin is to be rejected and the predetermined time has expired, projection 22 remains above exit passageway 30 to deflect the coin towards and into exit passageway 29. If the following coin or coins are also to be rejected, the projection remains above exit passageway 30 to deflect those coins towards and into exit passageway 29.

(c) If the coin following that of (a) above is also a coin being accepted and the predetermined time has not expired, the predetermined time is reset so that electromagnet 18 remains energised for a further time being the predetermined time to thus have accept exit passageway 30 clear for that coin to also continue its free-fall. If a number of acceptable coins are placed in the mechanism simultaneously, or at intervals less than the predetermined time, they can therefore free-fall through reference path 12 towards and into accept exit passageway 30 at the maximum speed, without risk of jamming as electromagnet 18 remains energised and projection 22 withdrawn until the expiry of the predetermined time after the signal for the last of the acceptable coins. The electromagnetic 18 is then de-energised and arm 21 allowed to move under the influence of spring 24 so that projection 22 blocks accept exit passageway 30. The holding of arm 21 by electromagnet 18 in the accept position in this manner can therefore be for as long as is required to allow a stream of acceptable coins to pass, irrespective of their number. There is no preset maximum time limit as the predetermined time is reset for each acceptable coin of the sequence.

(d) If the coin following that of (a) above is a coin to be rejected and thus directed down exit passageway 29 and the predetermined time has not expired, provided the delay close time has expired the electromagnet 18 is de-energised and arm 21 released under the influence of spring 24 to allow projection 22 to pass through opening 23 and thus block accept exit passageway 30, and deflect the leading edge portion of the following coin towards and into exit passageway 29.

(e) If the coin following that of (a) above is a coin to be rejected and thus deflected towards and into exit passageway 29 and the predetermined time has expired, electromagnet 18 is not energised and the mechanism stays in the rest position shown in FIG. 1 to enable projection 22 to deflect the leading edge portion of the coin towards and into exit passageway 29. The same result would occur if the coin were a single coin, or the first coin of a series of coins.

However, step (a) cannot commence if a previous coin/token was being deflected towards and into reject passageway 29 and a preset open delay time had not expired.

The predetermined time is longer than the coin transition time through the sorter 10 (the time taken to pass from the detection point in (a) above to exit from any outlet) so that it is known that all the coins in a multi-coin feed stream have exited the sorter 10 and therefore electromagnet 18 can be de-energised to allow projection 22 to block accept exit passageway 30 with certainty that there are no coins in the sorter 10, and thus there is no possibility of mis-direction or jamming.

The preset open delay time is the time taken for the leading edge portion of a deflected coin to travel from the point of deflection (projection 22) into the exit passageway 29. This is likely to be the time taken for the smallest coin to be processed to pass the point of deflection (projection 22).

As the projection 22 does not press against a wall when in the deflecting position, if a sequencing error does occur, the risk of jamming is significantly reduced. As the gap between the underneath of projection 22 and the top of partition 35 is greater than the thickness of a coin, jamming will not occur as a coin between partition 35 and projection 22 can slide-out and fall down either exit passageway. At worst, a temporary slowing and/or a misdirection may occur.

Therefore, sequence timing is controlled in the following ways:

(i) delay open timer—used to delay the energization of electromagnet 18 for a coin destined for passageway 30 to allow an earlier coin destined for passageway 29 to be deflected by projection 22 towards and into passageway 29 before electromagnet 18 is energised to withdraw projection 22 from passageway 30 to allow the coin destined therefor to free-fall into passageway 30.

(ii) delay close timer—used to delay the de-energization of electromagnet 18 to have projection 22 contact the leading edge portion of a coin destined for reject exit passageway 29 to allow a previous, accepted coin to pass into accept exit passageway 30 without being contacted by projection 22.

If the separator 10 was incorporated into a gaming machine, exit passageway 29 feeds the cash box whilst exit passageway 30 feeds a hopper. If the hopper is full a signal is given to the separator 10 to all direct coins/tokens to the cash box. When the coins in the hopper fall to a preset level a signal may be given to the separator 10 to direct particular coins/tokens to the hopper.

Likewise by attaching this type of sorter downstream of a coin validator which can distinguish multi denominations, it is possible to have the sorter direct certain value coins/tokens from a multi-denomination coin/token stream to a preselected exit passage.

As can be seen from the foregoing description, with the method of the present invention relatively high speeds with relatively high reliability may be achieved. For example, in a gaming slot machine, coin speeds of up to 15 coins per second may be required. With the present invention, the player coin feed rate determines the speed at which coins may be processed, not the arbitrary limits of the design or its operational procedure.

By having the projection 22 move only when required, for a steam of coins all destined for the accept passageway 30, the projection 22 offers no restriction either physically or in time and, thus, all coins have an uninterrupted free fall. This allows for maximum speed, and minimises problems with sequencing and thus jamming or incorrect direction.

The claims defining the invention are as follows:

1. A method of sorting coins/tokens according to predetermined information and allowing the coins/tokens to pass to a required outlet of a plurality of outlets in accordance with the predetermined information, including the steps of:

(a) detecting the presence of a leading edge portion of a coin/token falling into a free fall reference path above the plurality of outlets; and (b) if the predetermined information indicates the coin-token is to be allowed to pass to a predetermined one of the plurality of outlets:

(i) energising a solenoid to withdraw a separating means from the reference path at a location above the plurality of outlets to allow the coin/token to free-fall towards and into the predetermined outlet;

(ii) maintaining the solenoid energised, and thus the separating means withdrawn from the reference path, for a predetermined period of time;

(iii) resetting the predetermined time if the predetermined information indicates a following coin/token is also to be allowed to pass to the predetermined outlet; and (iv) de-energising the solenoid at the expiry of the predetermined period of time to allow the separating means to move into the reference path;

(c) if the predetermined information indicates the coin/token is to be deflected to pass to another of the plurality of outlets:

(i) if the solenoid is not energised maintaining the separating means in the reference path at a location above the plurality of outlets to deflect a leading edge portion of the coin/token to direct the coin/token towards and into the another outlet;

(ii) and if the solenoid is energised de-energising the solenoid to allow the separating means to move into the reference path above the plurality of outlets to deflect the leading edge portion of the coin/token to direct the coin/token towards and into the another outlet.

2. A method as claimed in claim 1, wherein the predetermined outlet is a continuation of the free fall reference path to any one of the plurality of outlets.

3. A method as claimed in claim 1, wherein the predetermined time is at least as long as the time taken for a coin/token to pass from the point of detection of step (a) until it has exited any one of the plurality of outlets.

4. A method as claimed in claim 1, wherein a preset open delay time is required to have expired before step (b)(i) can commence if a previous coin/token was to be deflected in accordance with step (c)(i) or (c)(ii).

5. A method as claimed in claim 4, wherein the preset open delay time is at least as long as the time taken for the leading edge portion of the previous coin/token to travel from the point of deflection into the another outlet.

6. A method as claimed in claim 4, wherein the preset open delay time is less than the time taken for the smallest coin to be sorted to pass the point of deflection.

7. A method as claimed in claim 4, wherein step (b)(i) can commence immediately the preset delay open time has expired.

8. A method as claimed in claim 1, wherein step (c)(ii) can commence immediately a preset close delay time has expired.

9. A method as claimed in claim 8, wherein the preset close delay time is the time taken for the leading edge portion of a coin to pass from the point of detection referred to in step (a) above, to the point where the leading edge portion is deflected in accordance with step (c)(i) or (ii).

* * * * *